US007535374B2

(12) United States Patent
Rieders

(10) Patent No.: US 7,535,374 B2
(45) Date of Patent: May 19, 2009

(54) SECURITY COVER

(75) Inventor: Lawrence J. Rieders, Maryland Heights, MO (US)

(73) Assignee: The Boeing Company, Chicago, IL (US)

( * ) Notice: Subject to any disclaimer, the term of this patent is extended or adjusted under 35 U.S.C. 154(b) by 297 days.

(21) Appl. No.: 11/538,629

(22) Filed: Oct. 4, 2006

(65) Prior Publication Data

US 2008/0084302 A1 Apr. 10, 2008

(51) Int. Cl.
*G08B 21/00* (2006.01)

(52) U.S. Cl. ..... 340/657; 340/539.1; 340/661; 340/664; 340/665; 340/668

(58) Field of Classification Search ..... 340/657, 340/660, 661, 664, 665–668, 539.1, 561, 340/562, 564, 565, 568.1, 568.2
See application file for complete search history.

(56) References Cited

U.S. PATENT DOCUMENTS

| | | | | |
|---|---|---|---|---|
| 5,798,703 | A * | 8/1998 | Sakai et al. | 340/666 |
| 6,040,764 | A * | 3/2000 | Crisci | 340/432 |
| 6,707,386 | B1 * | 3/2004 | Pruisner | 340/665 |
| 6,965,311 | B1 * | 11/2005 | Karner | 340/539.12 |
| 7,382,267 | B2 * | 6/2008 | Brendley et al. | 340/573.1 |

* cited by examiner

*Primary Examiner*—Davetta W Goins
(74) *Attorney, Agent, or Firm*—Klein, O'Neill & Singh, LLP

(57) ABSTRACT

A cover and method for protecting objects is provided. The cover includes a flexible sheet, wherein the sheet comprises a lower layer of a carbon fiber weave material; and an alarm module attached to the lower layer, wherein the alarm module comprises at least one sensor electrically connected to carbon fibers in the lower layer of the sheet for detecting a change in at least one attribute of the sheet and generating a signal triggering a notification system when the change in the at least one attribute exceeds predetermined maximum threshold levels.

30 Claims, 4 Drawing Sheets

SECURITY COVER

CROSS REFERENCE TO RELATED APPLICATIONS

NONE

BACKGROUND

1. Field of the Invention

This invention relates generally to protecting objects, and more particularly, to a security cover that may be placed over objects so that the objects may not be accessed without authorization.

2. Background of the Invention

Many companies and Government agencies attempt to protect certain types of information, for example, classified or competitive information. These organizations have certain guidelines/procedures for handling such information to prevent loss or compromise, unauthorized disclosure, dissemination, or duplication of such information. Sometimes, unauthorized disclosure of classified material may be punishable under the Federal Criminal Statutes or organizational policies.

Custodians or users who work with such information are expected to take reasonable precautions with such information. For example, a worker working with classified documents has to secure the documents if they leave their workstations. Additionally, individuals need to leave a location for a short period of time need to secure items such as a purse, keys, medical information, or any other items that the individual does not want anyone to see. This becomes inefficient, if a worker has to frequently leave their work station in between tasks because the worker has to secure the information before they leave and then access the information again when they come back.

In view of the above, what is needed is a method and system that can protect objects (which may include work stations where documents, engineering samples, prototypes, or any other object) without having to move the objects to secure storage or otherwise.

SUMMARY OF THE INVENTION

In one aspect of the present invention, a cover for protecting objects is provided. The cover includes a flexible sheet, wherein the sheet comprises a lower layer of a carbon fiber weave material; and an alarm module attached to the lower layer, wherein the alarm module comprises at least one sensor electrically connected to carbon fibers in the lower layer of the sheet for detecting a change in at least one attribute of the sheet and generating a signal triggering a notification system when the change in the at least one attribute exceeds predetermined maximum threshold levels.

In another aspect of the present invention, a cover for protecting objects is provided. The cover includes a flexible sheet, wherein the sheet comprises a lower layer of a carbon fiber weave material and an upper layer of a woven nylon material, and, wherein the lower layer and the upper layer are separated by the intermediate layer of a non-conductive wire mesh; and an alarm module attached to the lower layer, wherein the alarm module comprises at least one sensor electrically connected to carbon fibers in the lower layer of the sheet for detecting a change in at least one attribute of the sheet and generating a signal triggering an alarm when the change in the at least one attribute exceeds predetermined maximum threshold levels.

In yet another aspect of the present invention, a system for protecting objects is provided. The system includes a cover having a flexible sheet wherein the sheet comprises a lower layer of a carbon fiber weave material; an alarm module attached to the lower layer, wherein the alarm module comprises a cover interface having at least one sensor electrically connected to carbon fibers in the lower layer of the sheet for detecting a change in at least one attribute of the sheet, and a communication interface for generating a signal when the change in the at least one attribute exceeds predetermined maximum threshold levels; and a notification system for alerting a user to a disturbance in the cover.

In yet another aspect of the present invention, a method for protecting objects is provided. The method includes configuring an alarm module attached to a cover with threshold levels placing and securing the cover over an area; detecting a change in the at least one attribute of the cover; comparing the at least one attribute with the threshold levels; and triggering an alarm if the at least one attribute exceeds the threshold levels indicating a disturbance in the cover.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

The foregoing features and other features of the present invention will now be described with reference to the drawings of a preferred embodiment. The illustrated embodiment is intended to illustrate, but not to limit the invention. The drawings include the following.

DETAILED DESCRIPTION OF THE EMBODIMENTS

The following detailed description is of the best currently contemplated modes of carrying out the invention. The description is not to be taken in a limiting sense, but is made merely for the purpose of illustrating the general principles of the invention, since the scope of the invention is best defined by the appended claims.

Although the present invention is described with reference to protecting classified documents, those skilled in the art will recognize that the principles and teachings described herein may be applied to any object or material to cost effectively protect development, sensitive or proprietary information. Furthermore, the present invention could be used in homes, airports or anywhere where someone may be working with objects or materials that need to be dismantled or put away for sensitivity reasons.

Figure 1:
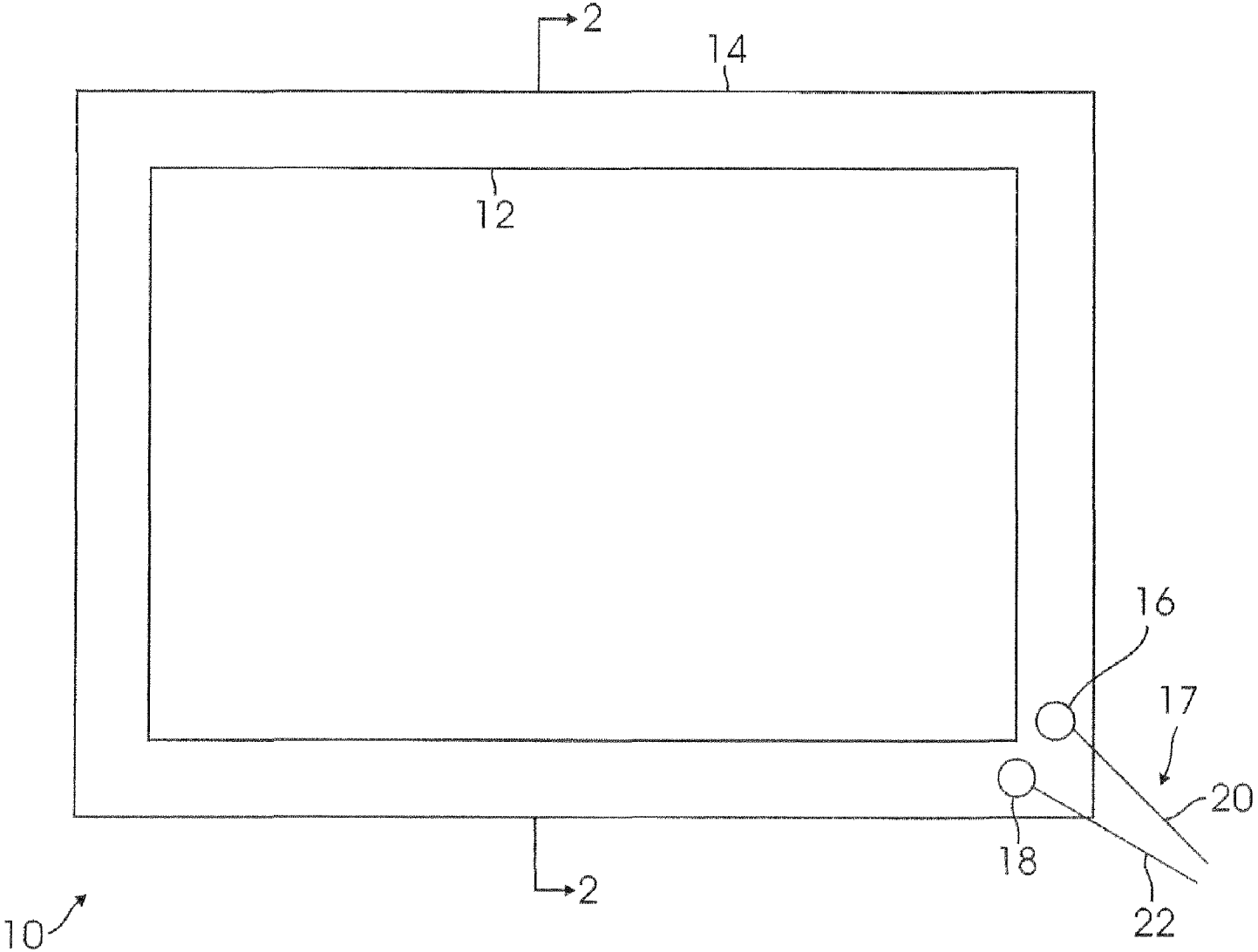
FIG. 1 illustrates a top view of a security cover, according to one aspect of the present invention.

Turning to FIG. 1, a top view of a flexible security cover 10, according to one aspect of the present invention, is illustrated.

Cover 10 comprises an outer periphery 14 and an inner periphery 12 creating a cavity in cover 10, where the cavity extends along the entire perimeter of cover 10. A cable or elongated tie strap 17 is inserted into the cavity for securing cover 10 to a specific area. Tie strap 17 comprises a first end 20 and a second end 22 extending outwardly from a first opening 16 and a second opening 18 in cover 10, respectively, where first opening 16 is adjacent to second opening 18 and both openings 16, 18 are located between inner periphery 12 and outer periphery 14 of cover 10. In a preferred embodiment, tie strap 17 is tied around a fixture, such as a pillar or piece of furniture, and a lock (not shown) secures the first and second ends 20, 22 together preventing removal of cover 10.

Cover 10 is placed over objects to conceal and protect the objects from being viewed or removed from an area without authorization. Any disturbance in cover 10 causes a notification signal to be generated and sent to a notification system (discussed below) alerting the user or security personnel to a potential disturbance or security violation. A disturbance occurs when cover 10 is moved, touched by an individual or an individual comes too close to cover 1I. The disturbance may cause an attribute to exceed a pre-set threshold level(s). Examples of such an attribute include static electricity, tension in cable, resistance, conductance and/or capacitance.

Pre-set (or pre-determined) threshold levels are values that may be set for plural attributes and a violation of such threshold values may trigger an alarm. Different levels may be set to trigger different alarm levels based on the seriousness of a security breach.

As discussed above, much time is wasted securing objects when the task requiring the use of the objects has not been completed. However, cover 10 of the present invention saves valuable time by allowing the user to secure the object by just covering it up. Although cover 10 is shown as rectangular, cover 10 can be of any shape. The shape and size of cover 10 is determined by the objects or area to be secured.

Figure 2:
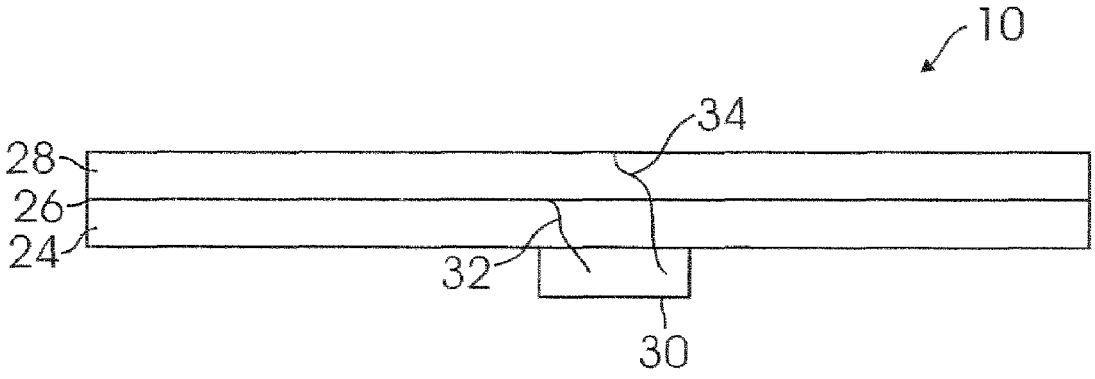
FIG. 2 illustrates a cross-sectional view of the cover taken along lines 2-2 of FIG. 1.

FIG. 2 illustrates a cross-sectional view of cover 10 taken along line 2-2 of FIG. 1. In a preferred embodiment, cover 10 comprises a lower layer 24 made from a carbon fiber weave material, an intermediate layer 26 made from a non-conductive wire mesh attached to the top of lower layer 24, and an upper layer 28 made from a woven nylon material attached to the top of intermediate layer 26.

Lower layer 24, intermediate layer 26 and upper layer 28 are attached to one another at the edges using known methods in the art. An alarm module 30 is attached to lower layer 24 for monitoring the attributes of cover 10 (such as resistance, capacitance, conductance, static electricity, motion, and tension in cable 17).

Although FIG. 2 illustrates cover 10 comprised of three layers, cover 10 is not limited to three layers. The number of layers in cover 10 is determined by the level of security, or priority level, desired by the user. For example, if a low level of security is required, only lower layer 24 of weaved nylon is needed. Static electricity sensors in alarm module 30 detect motion of cover 10 indicating unauthorized access.

For a medium level of security, a wire mesh, intermediate layer 26, is embedded into lower layer 24. An integrated circuit with associated sensors in alarm module 30 detects a disturbance by monitoring voltages sent through the wire mesh for changes.

For a high level of security, upper layer 28 made from a woven nylon material, is attached to the top of intermediate layer 26 creating a carbon fiber based cover. Sensors and associated integrated circuits in alarm module 30 detect a disturbance by changes in electrical resistance (through the conductive carbon fiber). Other electro conductive materials could be used and the integrated circuit tuned to react to changes in electrical properties related to those materials (conductance resistance, capacitance etc). Additional layers can be added to cover 10 to increase the priority of security level.

Figure 3:
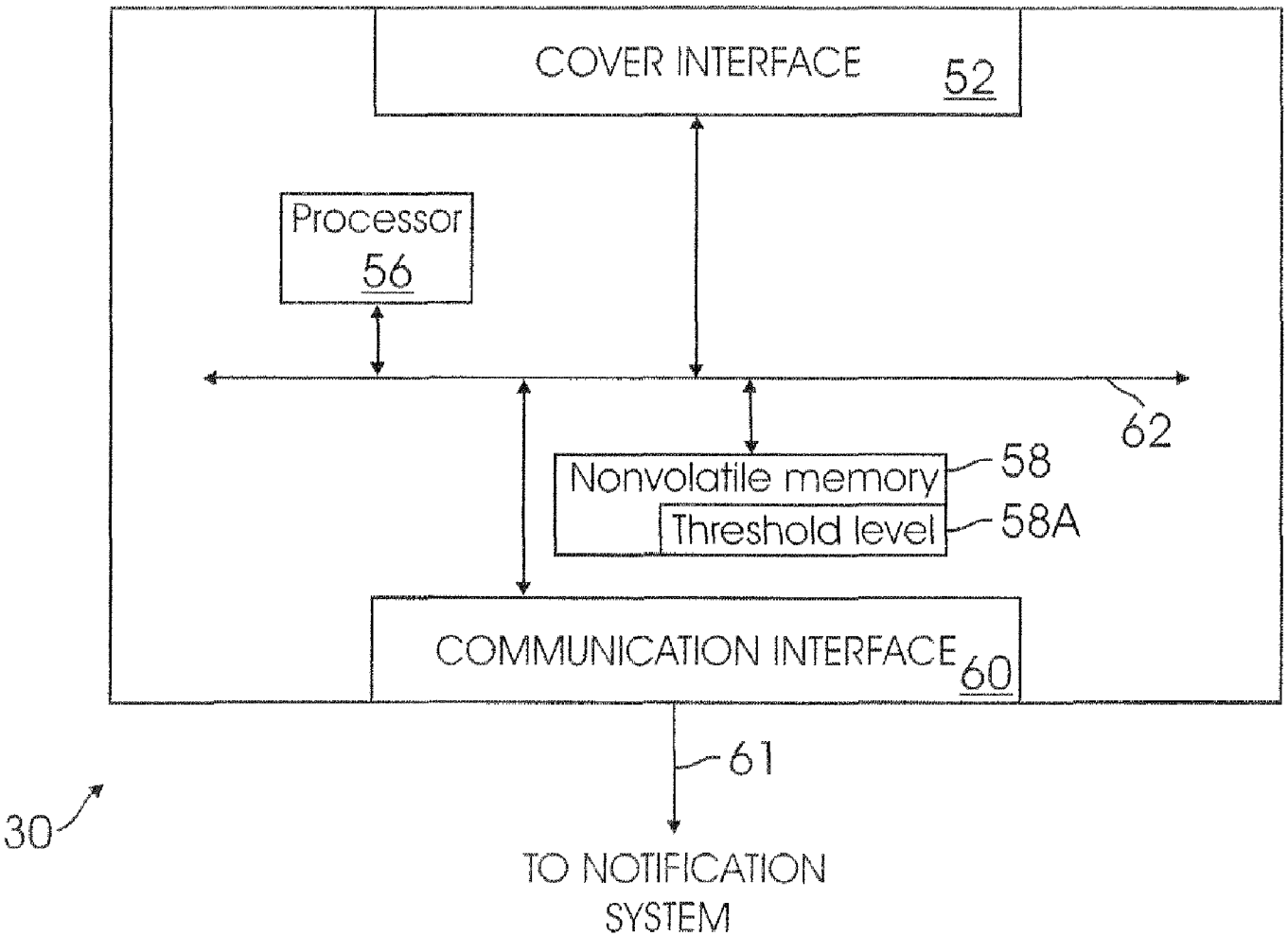
FIG. 3 illustrates a block diagram of an alarm module for detecting changes in attributes of a security cover according to one aspect of the present invention

FIG. 3 illustrates a block diagram of alarm module 30 for monitoring the attributes of cover 10, according to one aspect of the present invention. Alarm module 30 comprises a processor 56 that can execute program instructions out of non-volatile memory 58. Cover interface 52 is used to communicate with cover 10 and communication interface 60 is used to interface with notification system (for example, 36, FIG. 4). The structure and layout of these interfaces will depend on the type of protocol/standard that is being used to communicate with the notification system and cover 10, respectively.

Cover interface 52 interfaces alarm module 30 to lower layer 24 of cover 10. Cover interface 52 comprises one or more sensors 32, 34 depending on the alarm type (for example, disturbance, Electrostatic, etc), connected to one or more layers of cover 10 for monitoring/detecting any changes in the attributes of cover 10.

Predetermined/pre-programmed threshold levels 58A for plural attributes of cover 10 may be defined by a user and stored in alarm module 30 in non-volatile memory 58, such as random access memory ("RAM"), flash memory or read only memory ("ROM"). Microprocessor 56 can access non-volatile memory 58 via bus (or any other interface) 62.

When sensors 32, 34 detect a change in one or more attributes, microprocessor 56 compares the detected levels with pre-programmed threshold levels 58A. If the detected levels violate the threshold levels, then a disturbance in cover 10 may be assumed to have occurred. The more parameters violate their threshold levels, the greater the disturbance or violation in cover 10.

Figure 4:
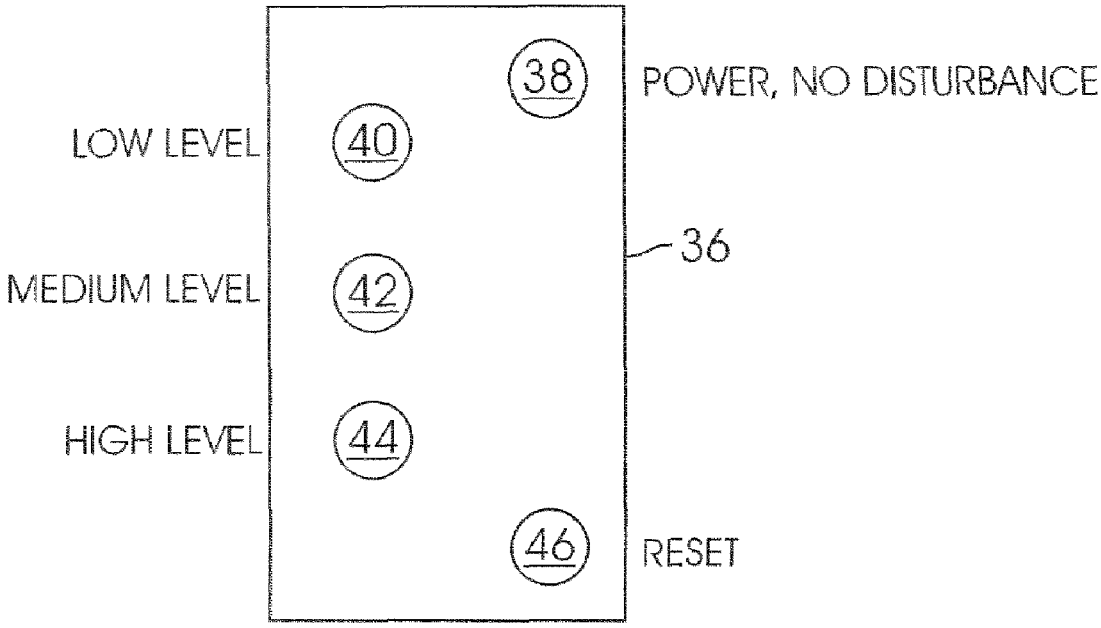
FIG. 4 illustrates a notification system for notifying users of a disturbance in a security cover, according to one aspect of the present invention.

When a disturbance is detected, alarm module 30 generates notification signal 61 which is transmitted to a notification system 36 (described below) through communication interface 60, such as a transmitter, alerting security personnel or the user to the disturbance or violation. The notification system can include, but is not limited to, a plurality of lights (as illustrated in FIG. 4), a noise/siren and an e-mail sent to the user or security personnel. Notification system 36 can be at a remote location being monitored by security personnel or located on site.

The present invention is not limited to using a microprocessors a reduced instruction set computer (RISC) processor or a hardware state machine may be used to monitor change in attributes to detect a disturbance.

In another aspect of the present invention, alarms module 30 may be implemented by using an Application Specific Integrated Circuit (ASIC) that interfaces with a computing system of conventional design, operation, and architecture.

In yet another aspect of the invention, the sensor can be built into cover 10.

FIG. 4 illustrates notification system 36, according to one aspect of the present invention. Notification system 36 is used as a remote controller for cover 10. Notification system 10 may include a biometric verification module (not shown) that authenticates a user, before a user can activate cover 130 to protect objects and detect any disturbance based on pre-programmed threshold level violations.

Notification system 36 is powered on by pressing a power button 38 or alternatively, activated remotely. A reset button 46 allows a user to reset system 36 and cover 10.

Notification system 36 includes a plurality of lights 40, 42, 44 for indicating priority levels of a detected disturbance. A low level 40 may indicate a momentary disturbance in cover 10; a medium level 42 may indicate a reoccurring disturbance in cover 10; and a high level 44 may indicate a constant disturbance in cover 10. Plurality of lights 40, 42, 44 can be of different color and/or intensity.

When one or more attributes exceed the pre-programmed threshold levels, notification system 36 detects the disturbance based on signal 61. The priority level is higher when more attributes exceed/violate the pre-programmed threshold levels 58A.

Figure 5:
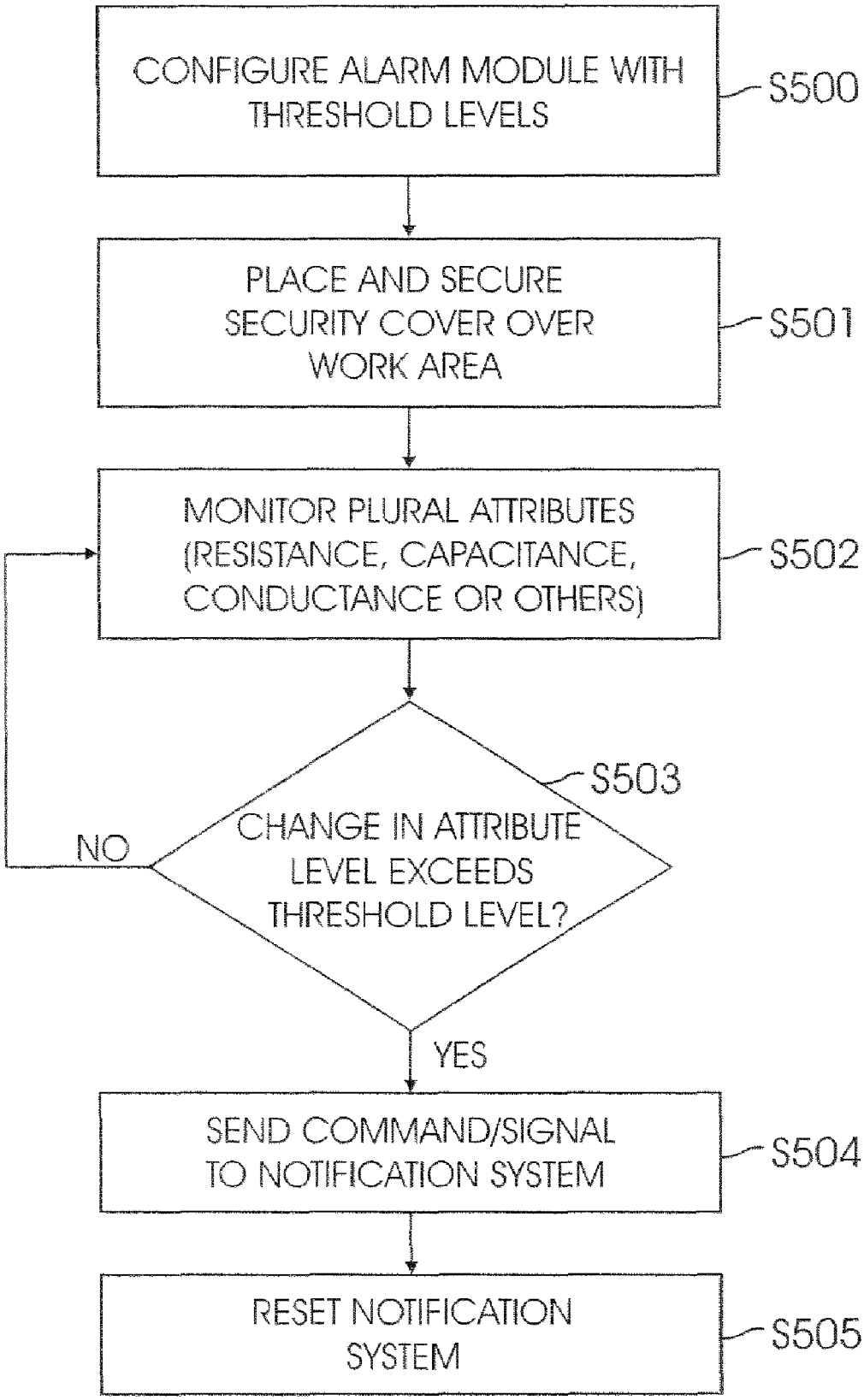
FIG. 5 is a flow chart illustrating the steps of protecting objects using a security cover, according to one aspect of the present invention.

FIG. 5 is a flow chart illustrating the process steps of protecting objects using a security cover. The method begins in step S500 by configuring alarm module 30 with pre-programmed threshold levels 58A and storing the predetermined maximum threshold levels in non-volatile memory 58. In step S501, cover 10 is paced over a work area and is secured with tie strap 17. Cover 10 can be activated by notification system 36. In one aspect, only authorized users may be allowed to activate cover 10. A bio-metric module may be used to authenticate a user.

In step S502, sensors in cover interface 52 of alarm module 30 continually monitor the attributes of cover 10.

Next, in step S503 alarm module 30 compares monitored/detected attribute levels with the pre-programmed threshold levels. Steps S502 and S503 are repeated until one or more attributes exceed one or more threshold levels.

In step S504, notification signal 61 is generated when one or more attributes exceed one or more threshold levels and notification system 36 is notified. Signal 61 may be sent using infra-red, wireless or as a wired packet. Corrective measures, if any, are taken after notification system 36 is notified. Thereafter, in step S505, notification system 36 is reset.

In one aspect of the present invention, a worker simply has to secure cover 10 on work areas and activate the secure cover by using a remote control (notification system 36). The worker does not have to put away all the contents and does not have to waste any time, While the present invention is described above with respect to what is currently considered its preferred embodiments, it is to be understood that the invention is not limited to that described above. To the contrary, the invention is intended to cover various modifications and equivalent arrangements within the spirit and scope of the appended claims.

What is claimed is:

1. A cover for protecting objects, comprising:

a flexible sheet; wherein he sheet includes a lower layer of a carbon fiber wave material; and an alarm module attached to the lower layer, wherein the alarm module includes it least one sensor electrically connected to carbon fibers in the lower layer of the sheet for detecting a change in at least one attribute of the sheet and generating signal for triggering a notification system when the change in the at least one attribute exceeds a predetermined maximum threshold level;

wherein the at least one attribute is selected from among a resistance, a conductance and a capacitance of the sheet; and the at least on attribute changes upon movement of the sheet or an individual touching the sheet;

wherein the change in the at least one attribute indicates a disturbance of the cover;

and a priority level is assigned to the disturbance;

wherein an alarm indicates the priority level of the disturbance; and the priority level includes a low level, a medium level and a high level.

2. The cover of claim 1, wherein the low level indicates a momentary disturbance; wherein the medium level indicates a reoccurring disturbance; wherein a high level indicates a constant disturbance; and wherein the notification system comprises a plurality of colored lights, each of the plurality of 1ights indicating a different priority level.

3. The cover of claim 1, wherein the notification system is located at a remote location.

4. The cover of in claim 1, wherein the notification system is located on a same site as the objects that are protected by the cover.

5. A cover for protecting objects comprising:

a flexible sheet having lower layer of a carbon fiber weave material and an upper layer of a woven nylon material, the lower layer and the upper layer being separated by an intermediate layer of non-conductive wire mesh; and an alarm module attached to he lower layer;

wherein he alarm module include at least one sensor electrical y connected to cart on fibers in the lower layer of the sheet for detecting a change in at least on attribute of the sheet and generating a signal for triggering an alarm when the change in the at least one attribute one exceeds a predetermined maximum threshold level;

wherein the at least one attribute is selected from a resistance, a conductance and a capacitance of the sheet; and the change in the at least on attribute indicates a disturbance of the cover;

wherein a priority level is assigned to the disturbance; and the alarm indicates the priority level of the disturbance;

wherein the priority level includes a low level, a medium level, and a high level; and wherein the low level indicates a momentary disturbance, the medium level indicates a recurring disturbance, and a high level indicates a constant disturbance.

6. The cover claim 5, further comprising:

an elongated tie strap positioned between the lower layer and the upper layer; wherein the elongated tie strap comprises a first end and a second end extending outwardly from a first opening and a second opening attached to tie outer periphery of the cover; and wherein the elongated tie strap secures the cover to at area.

7. A system for protecting, comprising:

a cover having a flexible sheet; wherein the flexible sheet includes a lower layer a carbon fiber weave material; an intermediate layer of a non-conductive wire mesh attached to the lower layer; and an upper layer of a woven nylon material attached to the intermediate layer;

an alarm module attached to the lower layer; wherein the alarm module includes cover interface having at least one sensor electrically connected to carbon fibers in the lower layer of the sheet for detecting a change in at least one attribute of the sheet, and a communication interface for generating a signal when the change in the at least one attribute exceeds a predetermined maximum threshold level; and a notification system for alerting a user to a disturbance in the cover;

wherein the at least one attribute is selected from a resistance, a conductance, an a capacitance of the sheet; and the at least one attribute changes upon movement of the sheet or an individual touching the sheet;

wherein the change in the at east one attribute indicates the disturbance of the cover; and a priority level is assigned to the disturbance; and wherein an alarm indicates the priority level of the disturbance; and the priority level includes a low level, a medium level, and a high level.

8. The system of claim 7, wherein the low level indicates a momentary disturbance; wherein the medium level indicate a reoccurring disturbance; wherein a high level indicates a constant disturbance; and wherein the notification system comprises a plurality of colored lights, each of the plurality of lights indicating a different priority level.

9. The system of claim 7, further comprising:

an elongated tie strap positioned between the lower layer and the upper layer; wherein the elongated tie strip comprises a first end and a second end extending outwardly front first opening and a second opening attached to the outer periphery of the cover, and wherein the elongated tie strap secures the cover to an area.

10. A method for protecting objects using a security cover, comprising:

configuring a plurality of threshold levels for an alarm module attached to the cover;

placing and securing the cover over an area;

detecting a change in the at east one attribute of th cover;

comparing the at least one attribute with the threshold levels; and triggering an alarm if the at least one attribute exceeds one of plurality of threshold levels indicating disturbance in the cover;

wherein the at least one attribute is selected from among a resistance, a conductance, and capacitance of the cover; and the at least one attribute changes upon movement of the cover or due to an individual touching the cover; and wherein a priority level is assigned to the disturbance; and the alarm indicates the priority level of the disturbance; and wherein the alarm comprising a plurality of colored lights, each of the plurality of lights indicating a different priority level.

11. The method of claim 10, wherein the priority level includes a low level, a medium level, and a high level; wherein the low level indicates a momentary disturbance; wherein the medium level indicates a reoccurring disturbance; and wherein a high level indicates a constant disturbance.

12. The cover of clam 1 further comprising;

an intermediate layer of a non-conductive wire mesh attached to the top of the lower layer.

13. The cover of claim 12, further comprising:

an upper layer of a woven nylon material attached to the intermediate layer.

14. The cover of claim 13, further comprising:

an elongated tie strap positioned between the lower layer and the upper layer; wherein the elongated tie strap comprises a first end and a second end extending outwardly from a first opening and a second opening attached to the outer periphery of the cover; and wherein the elongated tie strap secures the cover to an area.

15. A cover for protecting an object, comprising:

a sheet having at least a first layer is placed over th object; and an alarm module attached to the first layer;

wherein the alarm module includes at least one sensor operationally coupled to the first layer of the sheet for detecting a change in at least one attribute of the sheet, selected from among a resistance, a conductance and a capacitance of the sheet; and if the change in the at least one attribute, due to any movement in the sheet exceeds a threshold level, the alarm module generates a notification signal that is sent to a notification system that notifies a user; and wherein based on priority level, the change in the at least one attribute beyond the threshold value, is indicative of one or more of a low level disturbance, a medium level disturbance and a high level of disturbance for the cover.

16. The cover o claim 15, wherein the sheet includes second layer that is placed on top of the first layer.

17. The cover of claim 16, wherein the sheet includes a third, intermediate layer placed between the first layer and the second layer.

18. The cover of claim 15, wherein the first layer includes a carbon fiber weaved material.

19. The cover of claim 16, wherein the second layer includes woven nylon.

20. The cover of claim 17, wherein the third, intermediate layer includes a wire mesh.

21. The cover of claim 15, wherein the low level disturbance indicates a momentary disturbance

22. The cover of claim 15, wherein the medium level disturbance indicates a reoccurring disturbance.

23. The cover of claim 15, wherein the high level disturbance indicates a constant disturbance.

24. The cover of claim 15wherein the alarm module includes a cover interface that interfaces with the first layer of the sheet.

25. The cover of claim 15, wherein the threshold level is programmable and stored in a non-volatile memory for the alarm module.

26. The cover of claim 25, wherein to detect a disturbance, a processor for the alarm module compares the change in the at least one attribute with the threshold level stored at the non-volatile memory.

27. The cover of claim 15, wherein the alarm module transmits the notification signal to the notification system via a communication interface.

28. The cover of claim 15. wherein the notification system generates a plurality of colored lights and each of the plurality of lights indicates to the user a different priority level for a disturbance.

29. The cover of claim 15, wherein the notification system notifies the user via electronic mail.

30. The cover of claim 15, wherein the notification system generates an audible alarm for the user.

* * * * *